US005429103A

United States Patent [19]

Rich

[11] Patent Number: 5,429,103

[45] Date of Patent: Jul. 4, 1995

[54] HIGH PERFORMANCE IGNITION SYSTEM

[75] Inventor: Stanley R. Rich, Grantham, N.H.

[73] Assignee: Enox Technologies, Inc., Natick, Mass.

[21] Appl. No.: 761,682

[22] Filed: Sep. 18, 1991

[51] Int. Cl.[6] ..... F02P 3/08

[52] U.S. Cl. ..... 123/598; 123/643; 315/209 CD; 361/256

[58] Field of Search ..... 123/598, 606, 607, 643, 123/628; 315/209 CD; 361/256

[56] References Cited

U.S. PATENT DOCUMENTS

| | | | |
|---|---|---|---|
| 3,081,360 | 3/1963 | Kaehni | 123/606 |
| 3,302,629 | 2/1967 | Shano | 123/598 |
| 3,489,129 | 1/1970 | Issler et al. | 123/598 |
| 3,545,419 | 12/1970 | Nolting | 123/606 |
| 3,718,125 | 2/1973 | Posey | 123/598 |
| 3,782,353 | 1/1974 | Kammerer et al. | 123/148 |
| 3,818,885 | 6/1974 | Canup | 123/606 |
| 3,838,328 | 9/1974 | Lundy | 123/598 |
| 3,839,659 | 10/1974 | Bruijning et al. | 315/209 SC |
| 3,842,819 | 10/1974 | Atkins et al. | 123/169 MG |
| 3,897,767 | 8/1975 | Gordon et al. | 123/607 |
| 3,906,919 | 9/1975 | Asik et al. | 123/148 |
| 3,926,165 | 12/1975 | Merrick | 123/636 |
| 3,934,570 | 1/1976 | Asik et al. | 123/148 |
| 3,945,362 | 3/1976 | Newman et al. | 123/606 |
| 4,004,561 | 1/1977 | Thieme | 123/598 |
| 4,051,828 | 10/1977 | Topic | 123/606 |
| 4,061,113 | 12/1977 | Beyler | 123/26 |
| 4,068,643 | 1/1978 | McKechnie | 123/604 |
| 4,091,787 | 5/1978 | Frank | 123/606 |
| 4,112,890 | 9/1978 | Manger et al. | 123/606 |
| 4,131,100 | 12/1978 | Merrick | 123/598 |
| 4,138,977 | 2/1979 | Grather et al. | 123/637 |
| 4,149,508 | 4/1979 | Kirk, Jr. et al. | 123/598 |
| 4,161,936 | 7/1979 | Volsky | 123/606 |
| 4,162,665 | 7/1979 | Grather et al. | 123/637 |
| 4,164,912 | 8/1979 | Beyler | 123/26 |
| 4,174,695 | 11/1979 | Canup | 123/606 |
| 4,192,275 | 3/1980 | Weydemuller | 123/607 |
| 4,208,992 | 6/1980 | Polo | 123/415 |
| 4,217,872 | 8/1980 | Rabus et al. | 123/596 |
| 4,261,318 | 4/1981 | Igashira et al. | 123/628 |
| 4,288,723 | 9/1981 | Gerry | 315/209 R |
| 4,301,782 | 11/1981 | Wainwright | 123/620 |
| 4,326,493 | 4/1982 | Merrick | 123/606 |
| 4,328,771 | 5/1982 | Kawai et al. | 123/179.5 |
| 4,341,195 | 7/1982 | Nishio et al. | 123/598 |
| 4,345,576 | 8/1982 | Moseley et al. | 123/604 |
| 4,356,807 | 11/1982 | Tekura et al. | 123/606 |
| 4,359,998 | 11/1982 | Topic | 123/606 |
| 4,381,757 | 5/1983 | Marino et al. | 123/606 |
| 4,398,526 | 8/1983 | Hamai et al. | 123/606 |
| 4,407,255 | 10/1983 | Butler | 123/595 |
| 4,414,954 | 11/1983 | Canup | 123/606 |
| 4,428,349 | 1/1984 | Snow | 123/493 |
| 4,438,751 | 3/1984 | Iwasaki | 123/606 |
| 4,476,844 | 10/1984 | Kajino | 123/637 |
| 4,479,467 | 10/1984 | Burrows et al. | 123/606 |
| 4,522,185 | 6/1985 | Nguyen | 123/637 |
| 4,562,823 | 1/1986 | Moritugu et al. | 123/620 |
| 4,608,958 | 9/1986 | Sakakibara et al. | 123/605 |
| 4,653,459 | 3/1987 | Herden | 123/637 |
| 4,686,954 | 8/1987 | Brown | 123/607 |
| 4,688,538 | 8/1987 | Ward et al. | 123/598 |
| 4,710,681 | 12/1987 | Zivkovich | 315/209 T |
| 4,733,646 | 3/1988 | Iwasaki | 123/598 |
| 4,739,185 | 4/1988 | Lee et al. . | |
| 4,784,105 | 11/1988 | Brown | 123/607 |
| 4,787,360 | 11/1988 | Filippone | 123/606 |
| 4,820,957 | 4/1989 | Zivkovich | 315/209 T |
| 4,839,772 | 6/1989 | Choi et al. | 361/256 |
| 4,922,883 | 5/1990 | Iwasaki | 123/598 |
| 4,964,377 | 10/1990 | Scarnera | 123/605 |
| 5,056,496 | 10/1991 | Morino et al. | 123/604 |

*Primary Examiner*—Andrew M. Dolinar
*Attorney, Agent, or Firm*—Alan R. Loudermilk

[57] ABSTRACT

Apparatus and method for a plasma discharge for ignition in an internal combustion engine. A digital electronic system controls ignition performance and can provide an ignition discharge throughout an entire power stroke of a piston in a cylinder. The discharge can be controlled by a signal from a conventional distributor, crank trigger or other source.

43 Claims, 5 Drawing Sheets

PICK-UP DEVICE
12
26
27
13
ENGINE
10
DISTRIBUTION CIRCUIT
20
24-1
24-8
24-3
CYLINDER 3
ON
OFF
22
41
44
40
CLOCK
FLIP-FLOP
CLOCK AND TIMING CIRCUIT
SW1
SW2
43
L1
C2
V1
C1
60
VOLTAGE REGULATOR
LOAD
SPEED
DC SOURCE
62
46
50
CYLINDER 1
CYLINDER 2
83
82
72
81
70
SW1
SW2

HIGH PERFORMANCE IGNITION SYSTEM

FIELD OF THE INVENTION

The invention relates to apparatus and method for providing an ignition system for an internal combustion engine.

BACKGROUND OF THE INVENTION

Conventional ignition systems have a battery, an ignition coil, a condenser (capacitor), breaker points and a distributor. These systems are known to have a number of disadvantages related to durability and performance. For example, in a typical ignition system, the voltage available to make a spark is at a maximum at idling speeds and decreases as engine speed (or ignition frequency) increases. It would be preferred to have a higher voltage available for the spark at higher firing frequencies.

With advances in solid state electronics, transistorized electronic ignition systems have become available, and automobile manufacturers now typically provide either inductive or capacitive discharge ignition systems with their products. An inductive discharge ignition system uses a transistor to cut off the current flowing in the primary winding of the ignition coil. A capacitive discharge ignition system typically uses a silicon controlled rectifier to discharge a previously charged capacitor through the primary winding of the ignition coil. As in the conventional ignition system, the voltage applied to the spark plug in an electronic ignition system typically decreases as engine speed increases.

Because the duration of the spark in the above-described ignition systems is typically relatively short (between 50 and 150 microseconds), the amount of energy that the spark plug delivers within the cylinder is limited. Moreover, if the air-to-fuel ratio is not ideal for combustion during this extremely short period of spark duration, combustion will either not occur or will be only partially complete. Spark plugs therefore become fouled, misfire and require frequent cleaning or replacement.

Recently, there has been some development toward the use of a high energy plasma to ignite fuel mixtures, and toward the use of multiple sparks and extended ignition systems. The plasma ignition systems however appear to have higher cost, more limited durability and higher energy requirements compared to other types of ignition systems, and they typically require a specially produced, extremely short-lived plasma plug. These systems also do not appear to provide ignition energy of long enough duration in each cylinder to ensure that substantially all combustible components of the fuel are ignited and fully burned.

SUMMARY OF THE INVENTION

A method and apparatus are disclosed in which a continuous plasma discharge may be created throughout the power stroke of each cylinder of an internal combustion engine using a conventional spark plug. A digital electronic system controls ignition performance without requiring extensive engine modification or special spark plugs.

The system disclosed herein is applicable to any internal combustion engine that requires ignition for its operation. It draws less power than conventional high energy ignition systems and can provide an ignition discharge throughout an entire power stroke, thus permitting more complete fuel combustion, reduced polluting emissions and increased engine efficiency. The discharge is controlled by a signal from a conventional distributor, crank trigger or other source that produces an accurate timing signal.

The invention described herein is particularly well-suited to conventional internal combustion engines since it is low cost and easily retrofitable using standard spark plugs as continuous fuel igniters. The disclosed invention also will improve the performance of diesel engines that ordinarily do not use ignition systems.

BRIEF DESCRIPTION OF THE DRAWING

The present invention will be better understood hereinafter as a result of a detailed description of the invention when taken in conjunction with the following drawings in which.

DETAILED DESCRIPTION OF THE INVENTION

Figure 1:
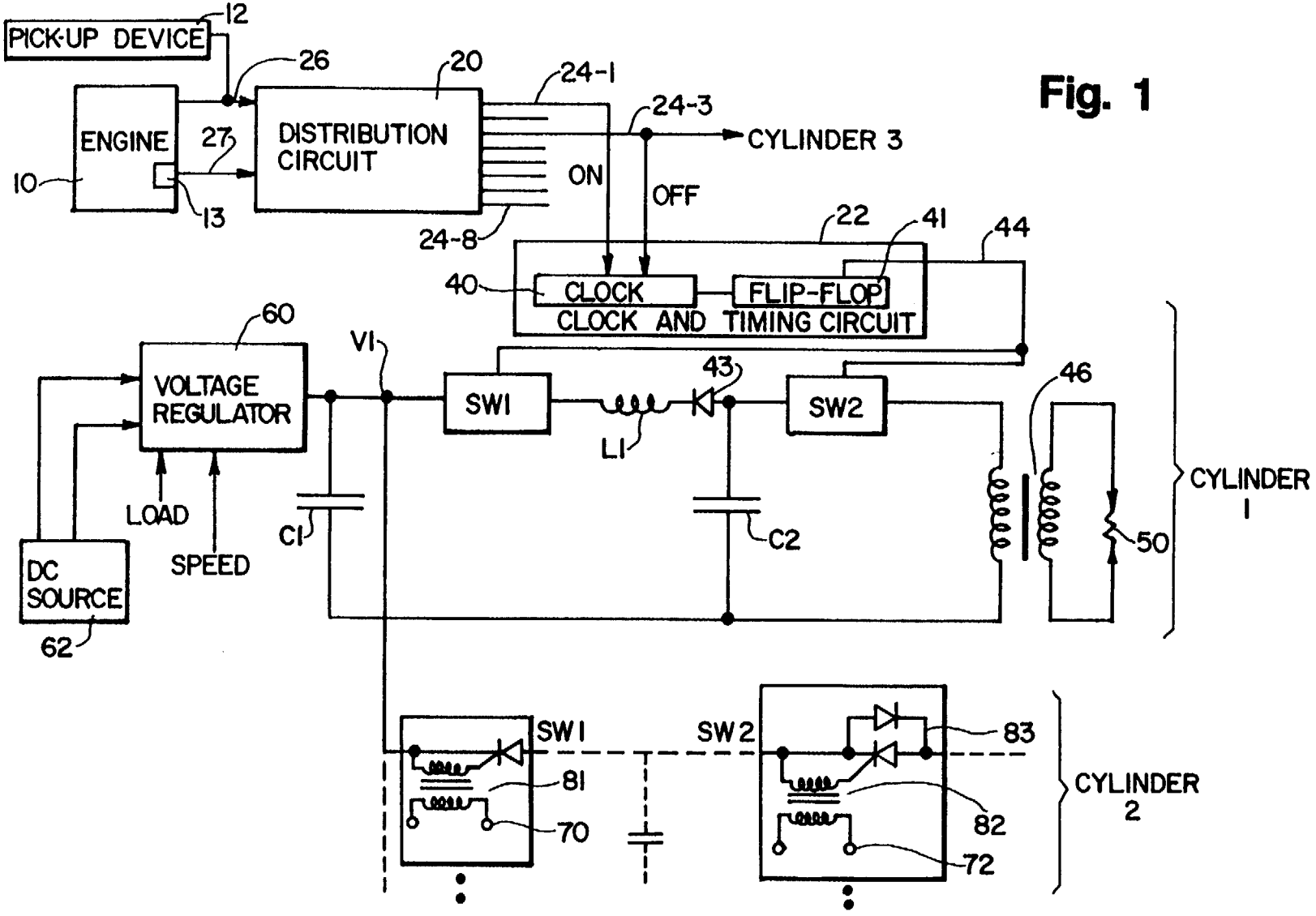
FIG. 1 is a block diagram of one embodiment of the invention.

With reference to FIG. 1, a first embodiment of the present invention is described. A pickup device 12, which can be connected to an engine 10 by means of a conventional distributor, crank trigger or other source and can be triggered by the ignition "points" or by magnetic or optical means, produces a series of timing pulses 26 indicative of piston position. A separate sensor 13 provides a signal 27 indicative of the position of the piston in cylinder 1. With these two signals, the precise location of any cylinder piston can be determined.

Distribution circuit 20 receives the serial stream of timing pulses 26 and signal 27. Circuit 20 thereafter generates signals on parallel output lines 24-1 to 24-8 to control spark plug firing in the respective cylinders. In FIG. 1, distribution circuit 20 is shown having eight parallel output lines 24-1 to 24-8 for controlling plasma discharge in cylinders 1 to 8. Of course, the invention will work for an engine having any number of cylinders.

Figure 2A:
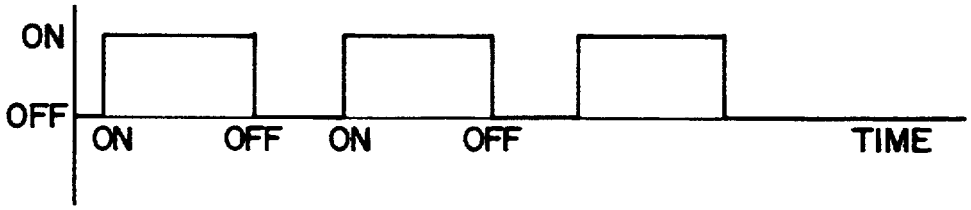
FIGS. 2A–2D are timing diagram depicting typical signals controlling the timing and energy input to the spark plugs in the described invention.
Figure 2B:
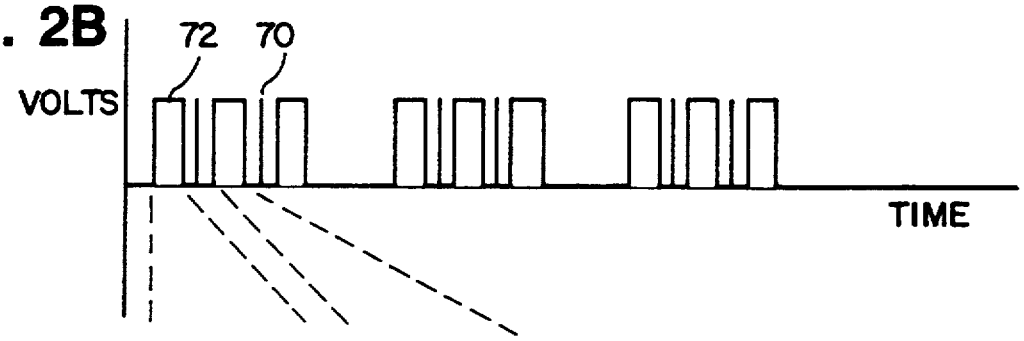
Figure 2C:
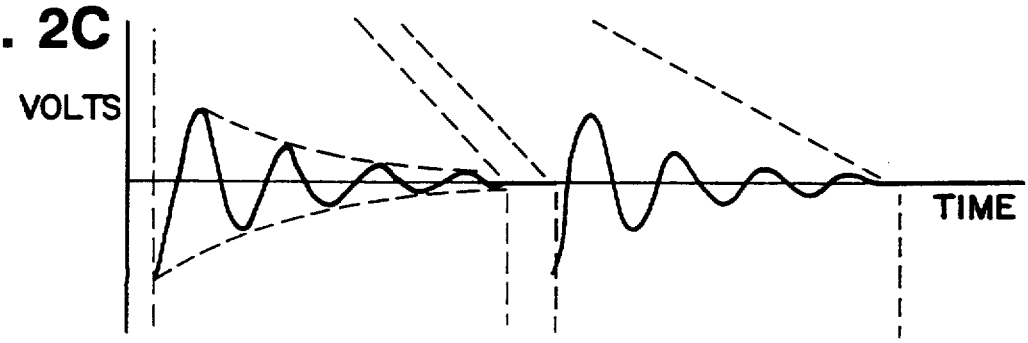
Figure 2D:
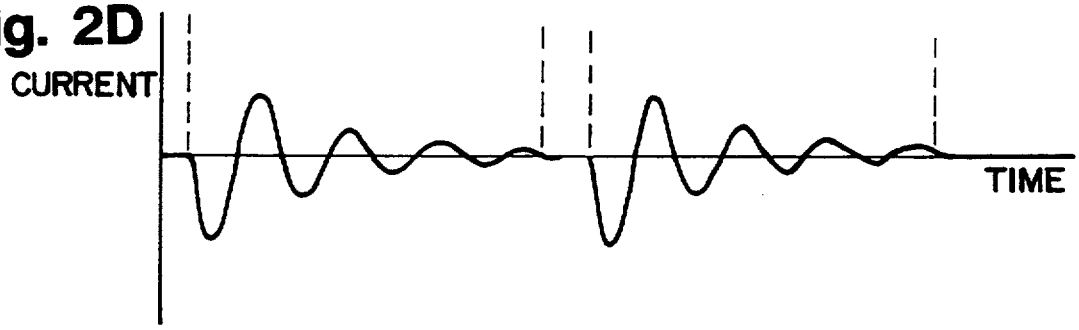

Each one of the output lines 24-1 to 24-8 is coupled to a clock and timing circuit 22. In the preferred embodiment, each cylinder has its own clock and timing circuit 22. The timing circuit 22 for cylinder 1 receives its ON signal when it is required from output line 24-1, the timing circuit 22 for cylinder 2 receives its ON signal from output line 24-2 at the proper time and so on. In the embodiment described with reference to FIG. 1, the OFF signal is the ON signal of a selected succeeding cylinder. For example, if it is desired to have a continuous ignition discharge for the entire power stroke of 180 crank angle degrees in an 8 cylinder engine, the OFF signal for cylinder 1 is the ON signal for cylinder 3, the OFF signal for cylinder 2 is the ON signal for cylinder 4, and so on. Other combinations are also possible; for example, ignition will exist for half of the power stroke (90 degrees) if the cylinder 2 ON signal ends the ignition in cylinder 1, and ignition will last for the entire power stroke plus half of the exhaust stroke (270 degrees) if the cylinder 4 ON signal is the OFF signal for cylinder 1. These relationships are valid and exact regardless of engine speed. Waveform A in FIG. 2 (i.e., FIG. 2A) represents the ON/OFF period for the clock and timing circuit 22 of a typical cylinder operating in accordance with the invention.

Within each clock and timing circuit 22, a clock 40 is coupled to an arithmetic flip-flop 41. When the clock is on, circuit 22 produces pulses and platforms which control the ignition in the specified cylinder. In FIG. 2, pulse 70 and platform 72 of waveform B (FIG. 2B) indicate voltages which appear on the timing output line 44. Pulse 70 indicates the voltage at point 70 of FIG. 1 (at switch SW1 of cylinder 2), and typically lasts about 15 microseconds. Platform 72 indicates the voltage at point 72 of FIG. 1 (at switch SW2 of cylinder 2), and can last from 200 to 600 microseconds. When the timing circuit 22 receives an ON signal on line 24-1, the series of pulses 70 and platforms 72 shown in waveform B begin.

When platform 70 is at a high voltage, switch SW2 closes and capacitor C2 discharges through ignition coil 46, providing an oscillatory discharge at the spark plug 50. Waveform C of FIG. 2 (i.e., FIG. 2C) represents the voltage across the ignition coil, and waveform D (FIG. 2D) represents the current in the secondary winding. Note that current waveform D is 90 degrees out of phase from voltage waveform C.

Platform 72 is periodically interrupted by pulses 70 to permit the capacitor C2 to be recharged. Once an OFF signal is received, switch SW2 remains open until the next ON signal is received, thus allowing capacitor $C_2$ to remain charged. After an ON signal is received, and until an OFF signal is received, clock and timing circuitry 22 will provide control signals which will allow capacitor C2 to discharge through the primary ignition coil.

Switch SW1 couples voltage V1 to an inductor L1, which in turn is coupled to capacitor C2 and the input of the second switch SW2. Voltage V1 is controlled by a voltage regulator 60 connected to a direct current voltage source 62 which preferably provides between 200 and 300 volts. (Direct current voltage sources are well known in the art, and may comprise an alternator with a rectifier.) Inductance L1 and capacitor C2 are arranged so that when switch SW1 is closed, the voltage across capacitor C2 will rise to about twice the voltage V1, typically between 400 and 600 volts.

The voltage regulator 60 can adjust the voltage V1 based on any desired function or variable, including engine speed, load or fuel input. For example, regulator 60 can be controlled by a current or voltage proportional to speed as measured by engine rotation in revolutions per minute (RPM) or by a current or voltage proportional to fuel input as measured by throttle position or a signal to a fuel injector.

In the embodiment of FIG. 1, each cylinder has its own switches SW1 and SW2, inductance L1, capacitor C2, ignition coil 46 and spark plug 50, as well as its own timing circuit 22. In addition, a diode 43 may be interposed between inductor L1 and capacitor C2 and more than one spark plug 50 may be connected to a single ignition coil depending on the type of engine. The spark plugs and ignition coil can be of the standard types readily available in the industry.

The logic circuitry which generates the digital signals which control the discharge in the spark plug are common in TTL or CMOS logic families and the specific components can readily be chosen by one skilled in the art. For example, switches SW1 and SW2 can be silicon controlled rectifiers or MOSFET or bipolar transistors. With reference to the switches depicted for cylinder 2 in FIG. 1, one possible embodiment is shown where the switches comprise silicon controlled rectifiers (SCR) 81 and 82, and have a diode 83 connected across SCR 82 to permit current to flow in both directions.

Capacitor C1 should have sufficient capacitance to assure that the voltage across it remains relatively constant regardless of the demands put on it by the engine during operation. In practice, a capacitor of approximately 470 microfarads has been found to be appropriate for this use, but generally it may be between 200 and 2000 microfarads as determined by the requirements of a particular engine.

Capacitor C2 is chosen such that its capacitance value and that of the net inductance of the loaded ignition coil 46 allow the circuit to resonate at a frequency of about 2 to 15 kHz. A capacitance of approximately 1.5 microfarads has been found suitable for capacitor C2, although it may range from 0.5 to 8 microfarads depending on the requirements of the particular circuit.

Waveforms C and D of FIG. 2 (i.e., FIG. 2C and FIG. 2D) represent the voltage and current oscillations that occur when capacitor C2 is connected by switch SW2 to the spark plug through the primary coil. The waveforms are exponentially decreasing sinusoidal waves which repeat in a train of waveforms. There will be fewer members of this train of waveforms, that is, fewer capacitor discharges, as the time in each power stroke decreases. Indeed, at the highest engine speeds (above 5000 to 8000 RPM depending on the particular engine application), there may be time for only a single discharge.

Figure 3:
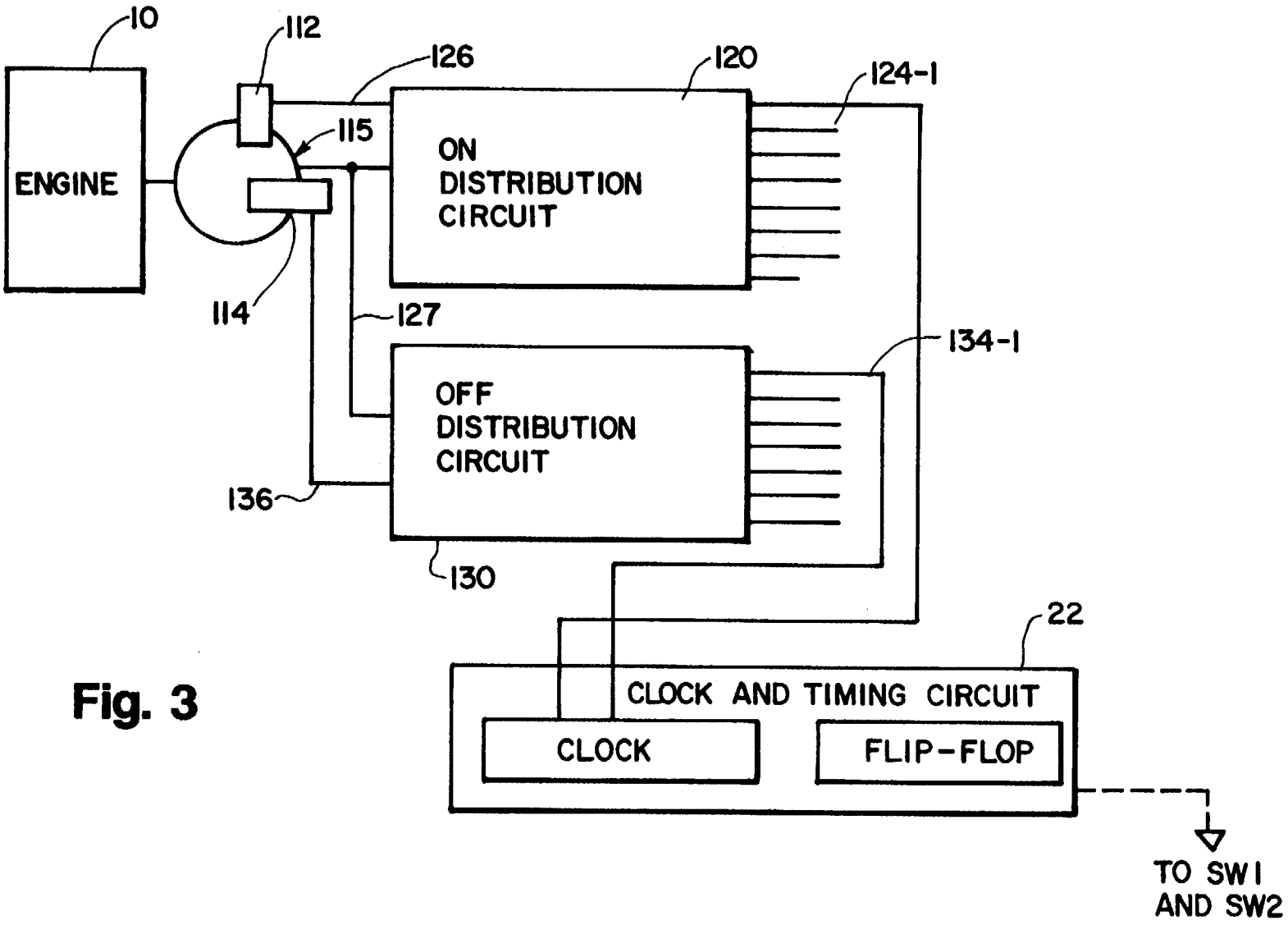
FIG. 3 is a block diagram of a second embodiment of the present invention.

Referring to FIG. 3, an embodiment for selecting the duration of the ignition discharge in each cylinder as measured by crank angle degrees is shown. This embodiment produces ON and OFF signals which are independent of engine rotation speed. As described in more detail with reference to the embodiment of FIG. 1, a pickup 112 generates a continuous series of timing pulses along line 126 which, along with a cylinder 1 identifying pulse 127 generated by a conventional pickup or other identifying element 115, are the inputs to an ON signal distribution circuit 120 which, in turn, generates a series of individual ON pulses 124 that are sent to the ignition circuits of individual cylinders in the proper predetermined sequence.

With the embodiment of FIG. 3, a second pickup 114, typically of the same type as pickup 112, is physically positioned some desired number of crank angle degrees (preferably from 15 to 330 degrees depending on the engine) behind the first pickup 112. Pickup 114 generates a second series of OFF timing pulses 136, which pulses occur the selected number of crank angle degrees after the corresponding ON timing pulses 126. The cylinder ignition and switching electronics for the embodiment of FIG. 3 are similar to those of the embodiment of FIG. 1.

The continuous series of OFF timing pulses 136, along with the cylinder 1 identifying pulse 127, are the inputs to an OFF pulse distribution circuit 130. This circuit, similar to the ON distribution circuit 120, generates a series of OFF pulses 134 which are distributed to the corresponding cylinder ignition circuits turned on by the ON pulses 124. Thus, for example, if continuous ignition discharge is initiated in cylinder 1 by an ON pulse 124-1, it can be turned OFF by the cylinder 1 OFF pulse 134-1. The timing system embodied in FIG. 3 allows the ignition discharge interval to be selected to have any desired duration in crank angle degrees.

Figure 4:
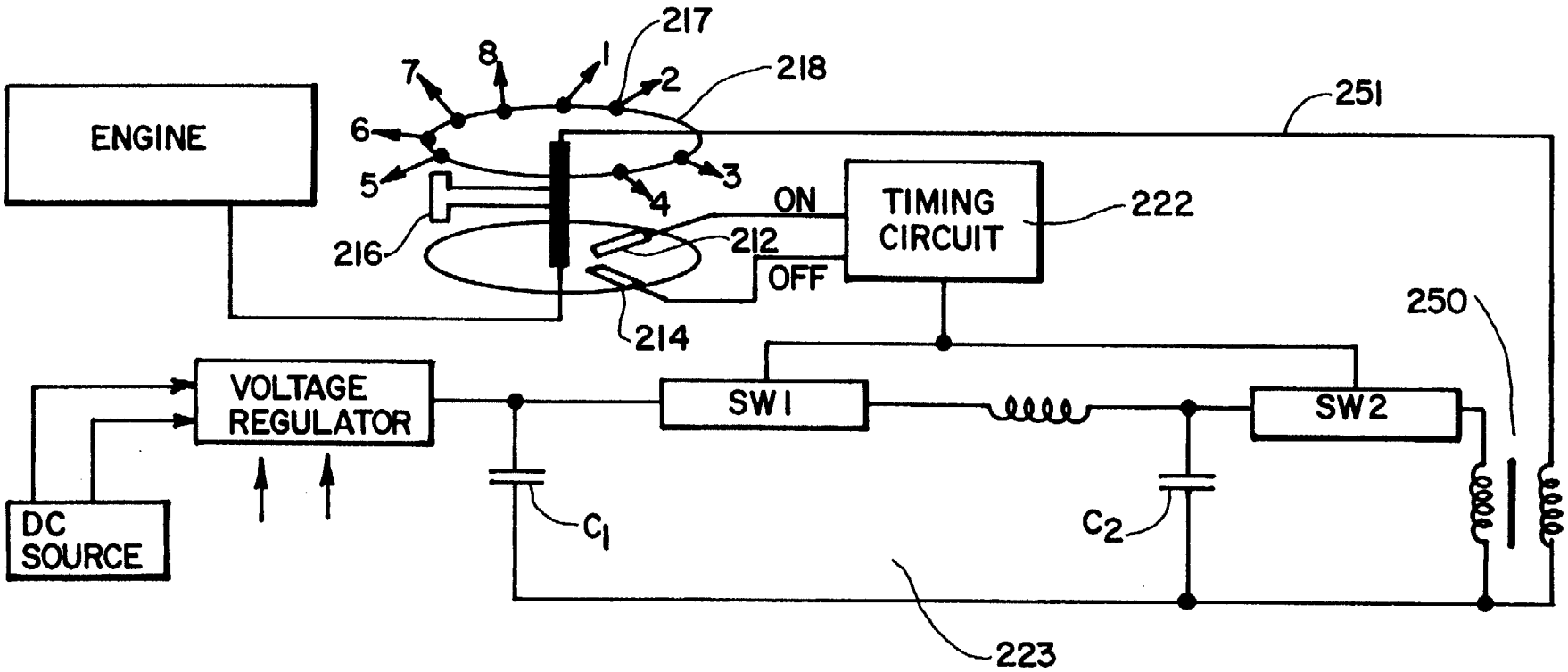
FIG. 4 is a block diagram of a third embodiment of the present invention.

With reference to FIG. 4, an embodiment of the invention is shown which uses a conventional distributor 218 to generate the timing pulses for timing circuit 222 which is similar to the timing circuits 22 described in FIG. 1. The distributor 218, however, distributes the ignition energy to the individual cylinders in proper sequence.

In this embodiment, the distributor 218 has either mechanical "points" or magnetic or optical ON and OFF sensors 212 and 214 that generate ON and OFF timing pulses that control a single timing circuit 222 that controls a single ignition energy generating circuit 223. Circuit 223 is similar to the ignition circuits described in the embodiment shown in FIG. 1. However, with this embodiment only one ignition circuit is needed, rather than the ignition circuit per cylinder of the FIG. 1 embodiment. The output from the single ignition coil 250 is distributed to the appropriate cylinder at the proper time by the rotor and distributor cap of distributor 218. The rotor "blade" 216 is broadened sufficiently to distribute the ignition energy over a wide angle to the individual spark plugs by the stator electrodes 217. With this embodiment, ignition energy is provided in each cylinder over 45 to 70 crankshaft angle degrees. This embodiment has been demonstrated on a dynamometer to produce 40 more horsepower, a 12% increase, while consuming 8% less fuel than a conventional high energy ignition system previously used on the same engine.

Tests have shown that unexpectedly with this ignition system, ignition advance of as much as 70° before the piston was at top center did not cause knocking or pre-ignition in the engine, whereas in a conventional spark system against which this system was compared, knocking occurred at 37° before the piston was at top center. In addition, with this system engine efficiency was measured as essentially constant over the range 32° to 47° before the piston was at top center, whereas by comparison, the conventional spark system showed a sharp peak of efficiency to which engine timing had to be exactly tuned to reach maximum efficiency. Adoption of the ignition system according to the present invention should make it possible to substantially eliminate both timing controls and the need for high-test or high octane gasoline in engines.

Figure 5:
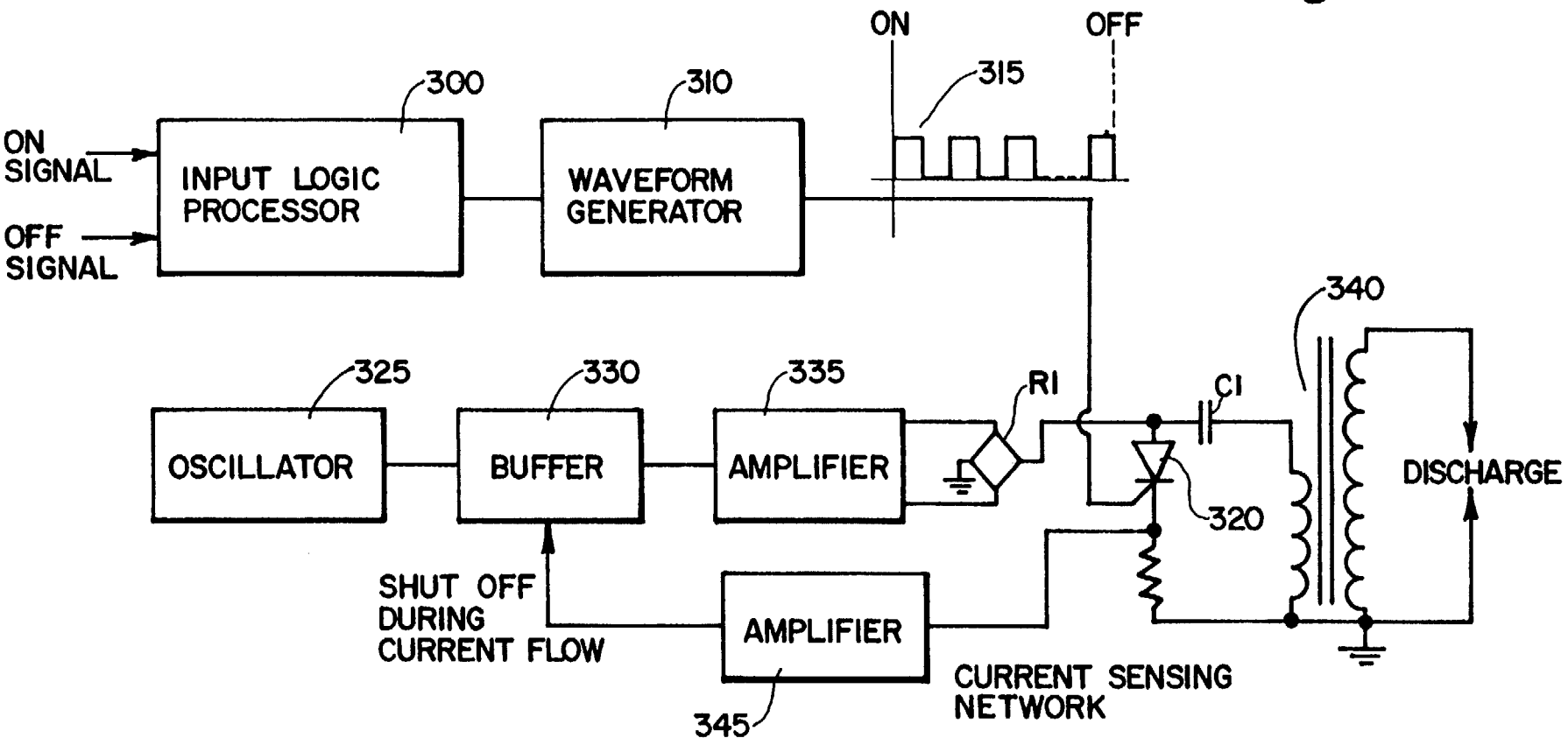
FIG. 5 is a block diagram of a fourth embodiment of the present invention.

An alternative embodiment of the electronic ignition system is shown in FIG. 5. ON and OFF signals generated by a distribution circuit as in any of the embodiments described above, are amplified and sharpened in an input logic processor 300, which turns on a waveform generator 310 to produce waveform 315. Waveform 315 is applied to the gate of an SCR 320, which acts as a switch to discharge capacitor $C_1$. Capacitor $C_1$ is charged to a high DC voltage by the rectified output of an oscillator 325 (rectified by rectifier R1), buffer 330, and amplifier 335, which are normally on. When the SCR 320 conducts, a voltage is sensed due to the current that flows in the circuit comprising the SCR 320, capacitor $C_1$, and the primary of the ignition coil 340. This voltage is amplified by amplifier 345 and acts to turn off the buffer 330.

When the voltage in waveform 315 is LOW, the SCR 320 does not conduct and the oscillator 325, buffer 330, and amplifier 335 again function at full power to recharge capacitor $C_1$ so that it can be discharged again when the gate of the SCR 320 is turned on by the succeeding HIGH voltage platform of waveform 315. The oscillator 325 runs continuously at a frequency between 18 and 100 kilohertz, usually chosen at 90 kilohertz. As shown in FIG. 5, the rectifier is referenced to ground, and the rectified output of oscillator 325, amplified by amplifier 335, is coupled to capacitor C1, which is coupled to the primary winding of ignition coil 340. With SCR 320 not conducting, and the primary winding of ignition coil 340 also referenced to ground as shown in FIG. 5, the charging current for capacitor C1 flows from the output of the rectifier through capacitor C1 and also through the primary winding of ignition coil 340 to the ground reference common with the rectifier.

This embodiment has the advantage of instant cutoff and instant restart of the oscillator 325, buffer 330, amplifier 335 chain, resulting in a fast recharge of capacitor $C_1$. Because oscillator 325 runs continuously, there is no delay in start up, as there is when using self-excited inverters that are common in previous capacitive discharge ignition systems. Another advantage of this embodiment is that the turn-off and turn-on is accomplished at low power levels in the buffer stage, allowing all controls to be at low power using TTL and CMOS logic elements.

The waveforms C and D of FIG. 2 (i.e., FIG. 2C and FIG. 2D) are exponentially decaying sinusoids. There are no pulses or sparks. The secondary circuit current waveform D compared to the primary circuit voltage waveform shows the essentially identical form of both applied voltage and "spark"-plug current. The continuous current waveform demonstrates that the discharge has generated a long lasting plasma that is ideal for stabilizing combustion and achieving optimum combustion.

Although several embodiments of the invention have been illustrated and described, it is anticipated that various changes and modifications will be apparent to those skilled in the art, and that such changes may be made without departing from the scope of the invention as defined by the following claims:

What is claimed is:

1. A system for igniting a fuel mixture in a cylinder, comprising: a discharge capacitor coupled to an ignition coil by means of a switch, wherein the circuit comprising said discharge capacitor and said ignition coil has a resonant frequency which generates a voltage across said ignition coil comprising a plurality of exponentially decaying sinusoidal waveforms when said switch is closed, and a charging circuit for charging said discharge capacitor through said ignition coil, the charging circuit comprising a buffered amplifier that amplifies a signal received from an oscillator, wherein when said switch is closed the buffered amplifier is off, and when said switch is open the buffered amplifier is on.

2. The system of claim 1, wherein said discharge capacitor is controllably discharged and charged beginning at a timing of up to about 70 degrees before top dead center.

3. The system of claim 1, wherein said discharge capacitor is controllably discharged and charged beginning at a timing of from about 32 to 47 degrees before top dead center.

4. The system of claim 1, wherein said discharge capacitor is controllably discharged and charged beginning at a timing of greater than 37 degrees before top dead center.

5. The system of claim 1, wherein said discharge capacitor may be controllably discharged and charged over a timing range of about 45 to 70 degrees before top dead center.

6. The system of claim 1, wherein the oscillator oscillates at a frequency in the range of about 18 to 100 kilohertz.

7. The system of claim 1, wherein the oscillator oscillates at a frequency of up to about 90 kilohertz.

8. The system of claim 1, further comprising a sensing element for sensing discharge of the capacitor, wherein the buffered amplifier is turned off in response to a signal generated by the sensing element.

9. An ignition system comprising:

a spark plug coupled to a first winding of an ignition coil;

a switching means coupling a discharge capacitor to a second winding of said ignition coil;

control means for opening and closing said switching means to couple said discharge capacitor to said ignition coil in synchronization with timing signals received from an engine sensor; and charging means coupled to said control means and said discharge capacitor for charging said discharge capacitor through said ignition coil, the charging means providing a rectified oscillating output signal generated from an oscillator when the charging means is operating to charge said discharge capacitor;

wherein said discharge capacitor generates a voltage across said ignition coil comprising a plurality of exponentially decaying sinusoidal waveforms.

10. The system of claim 9, wherein said discharge capacitor is controllably discharged and charged beginning at a timing of up to about 70 degrees before top dead center.

11. The system of claim 9, wherein said discharge capacitor is controllably discharged and charged beginning at a timing of from about 32 to 47 degrees before top dead center.

12. The system of claim 9, wherein said discharge capacitor is controllably discharged and charged beginning at a timing of greater than 37 degrees before top dead center.

13. The system of claim 9, wherein said discharge capacitor may be controllably discharged and charged over a timing range of about 45 to 70 degrees before top dead center.

14. The system of claim 9, wherein the oscillator oscillates at a frequency in the range of about 18 to 100 kilohertz.

15. The system of claim 9, wherein the oscillator oscillates at a frequency of up to about 90 kilohertz.

16. The system of claim 9, further comprising a sensing element for sensing discharge of the capacitor, wherein the oscillator circuit is turned off in response to a signal generated by the sensing element.

17. A method for igniting a fuel mixture in a cylinder of an engine, comprising:

generating a first signal indicative of piston position in a first cylinder, for beginning ignition in said first cylinder;

discharging and recharging a capacitor through the primary winding of an ignition coil in response to said first signal, the recharging of the capacitor being performed by providing to the capacitor a rectified oscillating signal generated from an oscillator;

generating a second signal indicative of piston position in a second cylinder for beginning ignition in said second cylinder;

and using said second signal to terminate ignition in said first cylinder.

18. The method of claim 17, wherein said discharge capacitor is controllably discharged and charged beginning at a timing of up to about 70 degrees before top dead center.

19. The method of claim 17, wherein said discharge capacitor is controllably discharged and charged beginning at a timing of from about 32 to 47 degrees before top dead center.

20. The method of claim 17, wherein said discharge capacitor is controllably discharged and charged beginning at a timing of greater than 37 degrees before top dead center.

21. The method of claim 17, wherein said discharge capacitor may be controllably discharged and charged over a timing range of about 45 to 70 degrees before top dead center.

22. The method of claim 17, wherein the oscillator oscillates at a frequency in the range of about 18 to 100 kilohertz.

23. The method of claim 17, wherein the oscillator oscillates at a frequency of up to about 90 kilohertz.

24. The method of claim 17, further comprising sensing discharge of the capacitor, wherein the oscillator circuit is turned off in response to a signal generated in response to sensing of discharge of the capacitor.

25. A method for reducing detonation in an internal combustion engine comprising the steps of:

furnishing a train of waveforms to a spark plug, wherein each element in the train includes an exponentially decaying sinusoid, and wherein each train comprises one or more such waveforms, the waveforms being produced by discharging and recharging a capacitor through the primary winding of an ignition coil coupled to the spark plug, the recharging of the capacitor being performed by providing to the capacitor a rectified oscillating signal generated from an oscillator.

26. The method of claim 25, wherein the frequency of said sinusoid is determined by the capacitance of said capacitor and the inductance of said ignition coil.

27. The method of claim 26, wherein said discharge capacitor discharges at said predetermined resonance frequency to cause a current through said spark plug having an exponentially decreasing sinusoidal waveform at said frequency.

28. The method of claim 25, wherein said discharge capacitor is controllably discharged and charged beginning at a timing of up to about 70 degrees before top dead center.

29. The method of claim 25, wherein said discharge capacitor is controllably discharged and charged beginning at a timing of from about 32 to 47 degrees before top dead center.

30. The method of claim 25, wherein said discharge capacitor is controllably discharged and charged beginning at a timing of greater than 37 degrees before top dead center.

31. The method of claim 25, wherein said discharge capacitor may be controllably discharged and charged over a timing range of about 45 to 70 degrees before top dead center.

32. The method of claim 25, wherein the oscillator oscillates at a frequency in the range of about 18 to 100 kilohertz.

33. The method of claim 25, wherein the oscillator oscillates at a frequency of up to about 90 kilohertz.

34. The method of claim 25, further comprising sensing discharge of the capacitor, wherein the oscillator circuit is turned off in response to a signal generated in response to sensing discharge of the capacitor.

35. A system for igniting an air-fuel mixture in a cylinder, comprising:

a capacitor coupled to an ignition coil;

a semiconductive switching device having a transconductive path and control electrode for controlling conduction through said path coupled to said capacitor and said ignition coil;

a control signal for turning said switching device on and off coupled to said control electrode; and charging means coupled to said capacitor for charging said capacitor through said ignition coil, the charging means providing a rectified oscillating output signal generated from an oscillator when the charging means is operating to charge said capacitor;

wherein when said switching device conducts, said capacitor discharges through said ignition coil, and when said switching device does not conduct, said capacitor charges by means of said charging means.

36. The system of claim 35, wherein said charging means comprises a buffered amplifier that amplifies a signal received from the oscillator; wherein when said switch permits the discharge of said capacitor, said buffered amplifier is off; and wherein when said switch permits the charging of said capacitor, said buffered amplifier is on.

37. The system of claim 36, further comprising a sensing element for sensing discharge of the capacitor, wherein the buffered amplifier is turned off in response to a signal generated by the sensing element.

38. The system of claim 35, wherein said discharge capacitor is controllably discharged and charged beginning at a timing of up to about 70 degrees before top dead center.

39. The system of claim 35, wherein said discharge capacitor is controllably discharged and charged beginning at a timing of from about 32 to 47 degrees before top dead center.

40. The system of claim 35, wherein said discharge capacitor is controllably discharged and charged beginning at a timing of greater than 37 degrees before top dead center.

41. The system of claim 35, wherein said discharge capacitor may be controllably discharged and charged over a timing range of about 45 to 70 degrees before top dead center.

42. The system of claim 35, wherein the oscillator oscillates at a frequency in the range of about 18 to 100 kilohertz.

43. The system of claim 35, wherein the oscillator oscillates at a frequency of up to about 90 kilohertz.

* * * * *